US005631218A

United States Patent [19]

Allan et al.

[11] Patent Number: 5,631,218

[45] Date of Patent: May 20, 1997

[54] ANTIMICROBIAL CLEANING COMPOSITIONS

[75] Inventors: Alexander Allan, Wirral; Ian M. George, Chester; Kenneth L. Rabone, Wirral, all of United Kingdom

[73] Assignee: Lever Brothers Company, Division of Conopco, Inc., New York, N.Y.

[21] Appl. No.: 469,946

[22] Filed: Jun. 6, 1995

[30] Foreign Application Priority Data

| | | | |
|---|---|---|---|
| Jun. 20, 1994 | [GB] | United Kingdom | 9412356 |
| Sep. 26, 1994 | [GB] | United Kingdom | 9419379 |
| Dec. 9, 1994 | [GB] | United Kingdom | 9424895 |
| Mar. 10, 1995 | [GB] | United Kingdom | 9504827 |

[51] Int. Cl.[6] ..... C11D 1/72; C11D 1/75; C11D 1/90; C11D 1/94

[52] U.S. Cl. ..... 510/423; 510/427; 510/433; 510/434; 510/501; 510/503

[58] Field of Search ..... 252/106, 546, 252/142, 174.21; 510/423, 427, 433, 434, 501, 503

[56] References Cited

U.S. PATENT DOCUMENTS

| | | | |
|---|---|---|---|
| 4,752,467 | 6/1988 | Konrad et al. | 424/70 |
| 4,844,886 | 7/1989 | Hartmann et al. | 424/62 |
| 4,920,100 | 4/1990 | Lehmann et al. | 514/23 |

FOREIGN PATENT DOCUMENTS

| | | |
|---|---|---|
| 056595 | 7/1982 | European Pat. Off. . |
| 123423 | 10/1984 | European Pat. Off. . |
| 284132 | 9/1988 | European Pat. Off. . |
| 331489 | 9/1989 | European Pat. Off. . |
| 435379 | 7/1991 | European Pat. Off. . |
| 442549 | 8/1991 | European Pat. Off. . |
| 3518929 | 11/1986 | Germany . |
| 3619375 | 12/1987 | Germany . |
| 57-166165 | 4/1981 | Japan . |
| 2-225404 | 2/1989 | Japan . |
| 3-044314 | 2/1991 | Japan . |
| 3044314 | 2/1991 | Japan . |
| 6145003 | 5/1994 | Japan . |
| 64162 | 12/1974 | Romania . |
| 87797 | 8/1983 | Romania . |
| 1164981 | 9/1969 | United Kingdom . |
| 1568358 | 5/1980 | United Kingdom . |
| 91/17237 | 11/1991 | WIPO . |

*Primary Examiner*—Paul Lieberman
*Assistant Examiner*—Gregory R. Delcotto
*Attorney, Agent, or Firm*—A. Kate Huffman

[57] ABSTRACT

A synergy is exhibited between surfactants selected from the group comprising amphoteric surfactants and alkoxylated alcohol surfactants and a certain class of aromatic organic acids. Alkoxylated alcohol surfactants are otherwise poorly biocidal at reasonable formulation pH's. Accordingly the invention relates to a disinfecting composition including: an ortho-hydroxy benzoic acid derivative (preferably salicylic acid), and, an amphoteric surfactant and/or an alkoxylated alcohol nonionic surfactant (preferably an ethoxylated alcohol), said composition having a pH of 1–5.5.

6 Claims, 3 Drawing Sheets

ANTIMICROBIAL CLEANING COMPOSITIONS

TECHNICAL FIELD

The present invention relates to an antimicrobial composition and to a method of treating surfaces with the said composition.

BACKGROUND TO THE INVENTION

Cleaning compositions generally comprise one or more surfactants, and, optionally, one or more hygiene agents.

Typical surfactants are selected from anionic, nonionic, amphoteric and cationic surfactants. Nonionics are very commonly used due to their effectiveness on fatty soils and the ease with which their foaming can be controlled. Of these surfactants, nonionics are reported as showing low biocidal activity, whereas certain anionic, cationic and amphoteric surfactants show biocidal activity under specific conditions of, for example, pH and concentration.

Typical hygiene agents include, strong acids, alkali's, phenolics, and oxidants such as peracids and hypohalites. These are generally highly reactive species which exhibit this reactivity in terms of one or more of, short shelf life, toxic, corrosive and irritant properties. In general, these components are required at relatively high levels in formulations.

Other less chemically reactive hygiene agents, such as 2,4,4'-trichloro-2'-hydroxy diphenyl ether (available in the marketplace as IRGASAN [RTM]), are effective at relatively low concentrations but are more expensive than simpler species and may be specific as regards their spectrum of activity.

In addition to the above, many organic acids, including benzoic, salicylic and sorbic are known as preservatives in cosmetics and some food products. These preservatives generally show lower biocidal activity than the above-mentioned chemically reactive hygiene agents when used at the same level.

A disinfectant can be understood to be a hygiene agent which shows a 100,000 fold or better reduction in the number of viable microorganisms in a specified culture when used at a level of around 0.5 wt %. This is generally known as a 'log 5 kill'. Of the organic acids mentioned above, salicylic acid is generally regarded as the most effective biocide against common bacteria, but its activity falls far short of that required of a disinfectant at practical concentrations.

DE 3619375 (Henkel) discloses that alkyl polyglycoside (APG) surfactants show a synergy with alcohols and organic acids as regards hygiene. The examples disclose compositions which comprise APG and organic acids including salicylic acid. These compositions are used at strongly acidic pH, generally below pH 3.

EP 0331489 (PARKE DAVIS PTY.) discloses a formulation for the treatment of acne which comprises a surfactant and a biocide. The examples illustrate the invention by reference to combinations of specific surfactants with specific biocides.

DE 3518929 (Hans-Joachim Gobel) disclose a formulation for the treatment of dandruff which comprises a commercially available hair washing composition, which is identified, but whose composition is not given, and salicylic acid.

RO 64162 (MIRAJ, 1974) discloses an anti-dandruff lotion which contains 10–30% wt ethanol, water, 0.5–3% wt salicyclic acid, 0.5–3% wt fatty acid alkoyl-betaine amide and 0.1–1% wt undecylenic acid monoethanolamide. It is believed that the salicyclic acid in such formulations is present as a keratolytic agent: causing dead skin tissue to be shed.

Hard surface cleaning compositions typically comprise one or more of anionic and nonionic surfactants. Of the nonionics, alkoxylated alcohols, particularly ethoxylated alcohols, are commonly used.

BRIEF DESCRIPTION OF THE INVENTION

We have determined that a marked synergy is exhibited between surfactants selected from the group comprising amphoteric surfactants and alkoxylated alcohol surfactants and a certain class of aromatic organic acids. It is believed that alkoxylated alcohol surfactants are poorly biocidal at reasonable formulation pH's.

Accordingly a first aspect of the present invention relates to a disinfecting composition including:

a) an ortho-hydroxy benzoic acid derivative, and, b) an amphoteric surfactant and/or an alkoxylated alcohol nonionic surfactant, said composition having a pH of 1–5.5.

A second aspect of the present invention provides a process for disinfecting non-living surfaces which comprises the step of treating the surface with a composition comprising:

a) an ortho-hydroxy benzoic acid derivative, and, b) an amphoteric surfactant and/or an alkoxylated alcohol nonionic surfactant said composition having a pH of 1–5.5.

A third aspect of the present invention comprises the use, in a process for the preparation of a disinfecting composition having a pH of less than 5.5 of an ortho-hydroxy benzoic acid derivative, and, at least one of an amphoteric surfactant and an alkoxylated alcohol nonionic surfactant.

DETAILED DESCRIPTION OF THE INVENTION

Figure 1:
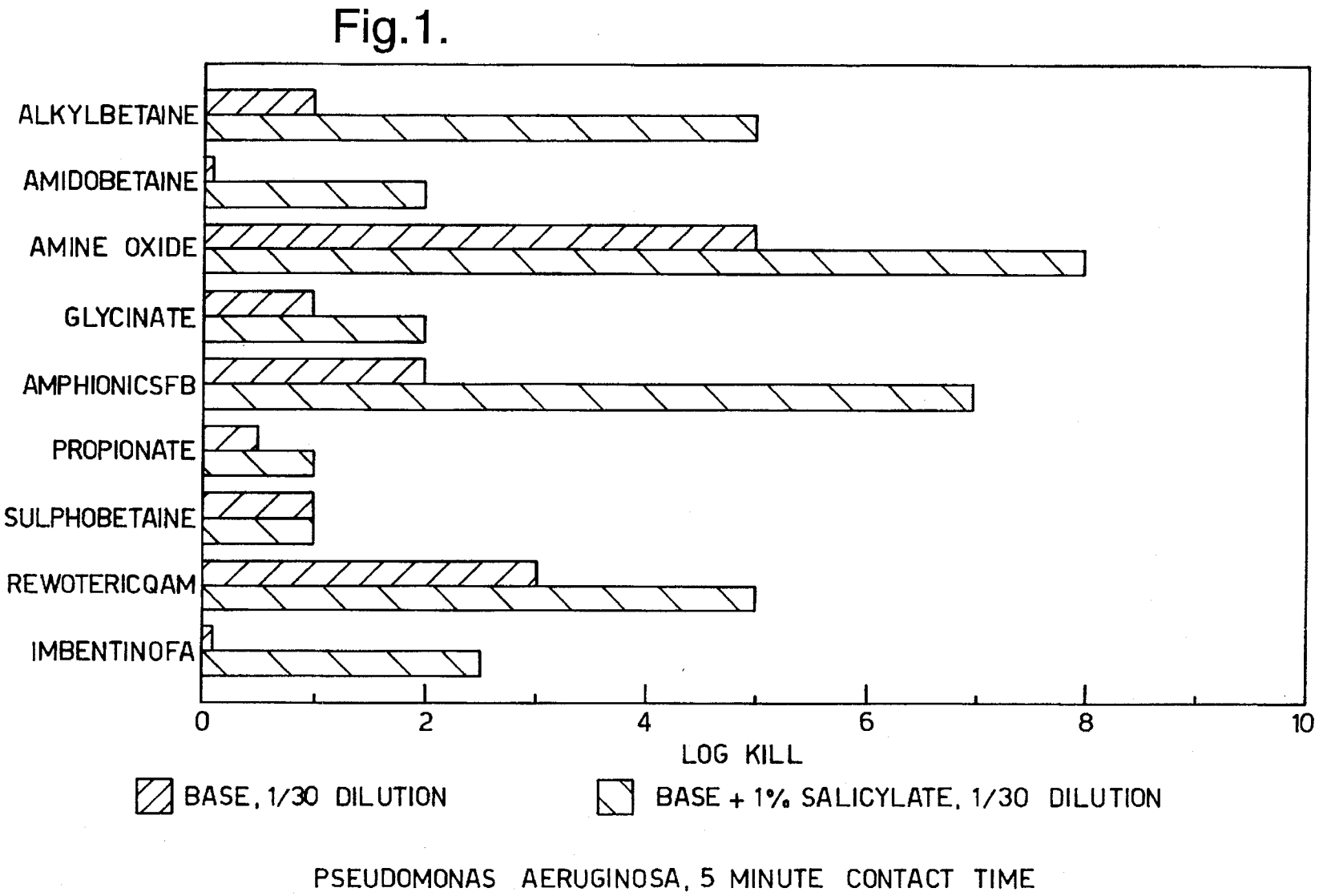

Suitable nonionic detergent active compounds can be broadly described as compounds produced by the condensation of alkylene oxide groups, which are hydrophilic in nature, with an organic hydrophobic compound which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Particular examples include the condensation product of aliphatic alcohols having from 8 to 22 carbon atoms in either straight or branched chain configuration with ethylene oxide, such as a coconut oil ethylene oxide condensate having from 4 to 10 moles of ethylene oxide per mole of coconut alcohol; condensates of alkylphenols whose alkyl group contains from 6 to 12 carbon atoms with 4 to 10 moles of ethylene oxide per mole of alkylphenol.

The preferred alkoxylated alcohol nonionic surfactants are ethoxylated alcohols having a chain length of C9–C11 and an EO value of at least 5 but less than 10. Particularly preferred nonionic surfactants include the condensation products of $C_{10}$ alcohols with 5–8 moles of ethylene oxide. The preferred ethoxylated alcohols have a calculated HLB of 10–16.

The amount of nonionic detergent active to be employed in the composition of the invention will generally be from 0.1 to 30% wt, preferably from 1 to 20% wt, and most preferably from 3 to 10% wt for non-concentrated products. Concentrated products will have 10–20% wt nonionic surfactant present, whereas dilute products suitable for spraying will have 0.1–5% wt nonionic surfactant present.

Typical levels of the aromatic carboxylic acid in formulations range from 0.01 to 8%, with levels of 0.05–4 wt %, particularly around 2% being preferred for normal compositions and up to two or four times that concentration being present in so called, concentrated products. For sprayable products the concentration of the aromatic carboxylic acid will be in the range 0.05–0.5% wt.

In general, whatever the strength of the product the ratio of the nonionic surfactant to the aromatic carboxylic acid will preferably be in the range 50:1 to >1:1, more preferably 30:1 to >1:1 i.e. an excess of nonionic will be present.

The preferred aromatic carboxylic acid is salicylic acid, which gives better hygiene results than benzoic and shows a very marked improvement as compared with sorbic acid.

Alternative acids are the polyhydroxyl carboxylic acids in which at least one of the hydroxyl groups is ortho- to the carboxylic acid group. The remaining hydroxyl group or groups can be in the remaining ortho-, para- or meta-configurations. The polyhydroxyl carboxylic acids exhibit the same synergy as the mono hydroxylic acid derivative (salicylic acid) but are believed to be less irritant.

It was also found that in the presence of nonionic surfactant, salicylic acid derivatives methylated at positions 3–6 exhibit an additional antimicrobial action over that obtained with salicylic acid. This was particularly true for gram positive bacteria and yeasts. In contrast hydroxylation at these sites was found to decrease the synergistic effect.

The preferred alkyl substituted ortho-hydroxy aromatic carboxylic acid of the general formula:

$$R1—C_6H_3(OH)(COOH)$$

wherein R1 is $C_{1-12}$ alkyl, and the hydroxyl group is ortho to the carboxyl group.

Preferably the alkyl substituted ortho-hydroxy aromatic carboxylic acids are substituted at the 3, 4 or 5-position, relative to the carboxyl group. Preferred chain lengths for the alkyl group are $C_{1-6}$, with methyl substituted acids being particularly preferred.

Particularly preferred acids are 2-hydroxy 5-methyl benzoic acid, 2-hydroxy 4-methyl benzoic acid and 2-hydroxy 3-methyl benzoic acid.

Preferred amongst the amphoteric surfactants are the betaines. However, we have determined that the synergy is also obtained by use of amine-oxide and alkyl-aminoglycinates. Betaines are preferred for reasons of cost, low toxicity (especially as compared to amine-oxide) and wide availability.

Typical betaines in compositions according to the invention are the amido-alkyl betaines, particularly the amidopropyl betaines, preferably having an aliphatic alkyl radical of from 8 to 18 carbon atoms and preferably having a straight chain. These betaines are preferred as they are believed to comprise relatively low levels of nitrosamine precursors although other betaines, such as alkyl betaines, can be used in the compositions of the invention.

Typical levels of amphoteric range from 0.01 to 8%, with levels of 1–5 wt %, particularly around 2% being preferred for normal compositions and up to four times the concentration being present in so called, concentrated products. As with the nonionic surfactant, lower levels or around 0.05–1% will be employed in sprayable products and higher levels of, typically, around 4% wt in concentrates. In general, the ratio of the betaine to the aromatic carboxylic acid will be in the range 1:3 to 3:1, with approximately equal levels on a weight basis being preferred.

The composition according to the invention can contain other minor, inessential ingredients which aid in their cleaning performance and maintain the physical and chemical stability of the product.

For example, the composition can contain detergent builders. In general, the builder, when employed, preferably will form from 0.1 to 25% by weight of the composition.

Metal ion sequestrants, including ethylene-diamine-tetraacetates, amino-polyphosphonates (such as those in the DEQUEST® range) and phosphates and a wide variety of other poly-functional organic acids and salts, can also optionally be employed. It is believed that the hygiene performance of the composition is improved by the presence of a metal ion sequesterant.

Citrate is particularly preferred as this functions as a buffer maintaining the composition at a pH in the range 3–5 on dilution. Typical levels of citrate range from 0.5–5%, with higher levels of 5–10% being used in concentrates and lower levels of 0.1–1% being used in sprayable products. Citric can be replaced by other suitable buffering agents to maintain the pH in this range. Citric is also preferred for environmental reasons and a lack of residues as it is believed to be the most cost/weight-effective acid.

Preferably the pH of the composition is 3.0–4.5. It is believed that above pH 4.5 the hygiene benefit of the compositions falls off and below pH 3.0 surface damage may occur. The preferred pH range is 3.2–4.0 in use. The most preferred pH is around 3.5. Compositions having a pH of less than 3.0 will damage enamel surfaces. Compositions having a pH above 4.5 will show reduced kill against micro-organisms. In typical waters from hard water areas citrate at a level of 3.5% will be sufficient to reduce the pH on addition of the product of the present invention at 3.3g/1 to a pH below 4.0.

Hydrotropes, are useful optional components. It is believed that the use of hydrotropes enables the cloud point of the compositions to be raised without requiring the addition of anionic surfactants. The presence of both anionic surfactants and betaine is believed to be detrimental to the formulations as these surfactants interact with the amphoterics to form a complex which inhibits the hygiene activity of the amphoterics. Preferably the formations according to the invention are free of anionic surfactants when betaine is present, or contain low levels of anionic surfactants, i.e. less than 50% of the level of the betaine. Anionics are compatible with alcoholethoxylate based compositions according to the present invention.

Suitable hydrotropes include, alkali metal toluene sulphonates, urea, alkali metal xylene and cumene sulphonates, polyglycols, >20EO ethoxylated alcohols, short chain, preferably $C_2$–$C_5$ alcohols and glycols. Preferred amongst these hydrotropes are the sulphonates, particularly the cumene, xylene and toluene sulphonates.

Typical levels of hydrotrope range from 0–5% for the sulphonates. Correspondingly higher levels of urea and alcohols are required. Hydrotropes are not always required for dilute, sprayable products, but may be required if lower EO or longer alkyl ethoxylates are used or the cloud point needs to be raised considerably. With a product comprising 5% wt C9–C11 8EO ethoxylated alcohol, 2% salicylate, 3.5% citrate and a 0.3% wt of a perfume: 3.4, 2.1 and 1.1% wt of sodium toluene-, sodium xylene- and sodium cumene-sulphonates were required respectively to achieve a cloud point at or above 50 Celcius. The cumene sulphonate is the most preferred hydrotrope.

Polymers are optional components of the formulations of the present invention. Anionic polymers are particularly preferred as these have been determined to have both an improved initial cleaning benefit and a secondary benefit in that redeposited soil is more easily removed. In the context of the present invention, anionic polymers are those which carry a negative charge or similar polymers in protonated form. Mixtures of polymers can be employed. It should be noted that the beneficial effect of anionic polymers is reduced by the presence of anionic surfactants. In the compositions of the present invention anionic are generally absent when polymers are present.

The preferred polymers in embodiments of the present invention are polymers of acrylic or methacrylic acid or maleic anhydride, or a co-polymer of one or more of the same either together or with other monomers. Particularly suitable polymers include polyacrylic acid, polymaleic anhydride and copolymers of either of the aformentioned with ethylene, styrene and methyl vinyl ether.

The most preferred polymers are maleic anhydride co-polymers, preferably those formed with styrene, acrylic acid, methyl vinyl ether and ethylene. Preferably, the molecular weight of the polymer is at least, 5000, more preferably at least 50,000 and most preferably in excess of 100,000. The molecular weight of the polymer is preferably below 1 000 000 Dalton. As the molecular weight increases the cleaning benefit of the polymer is reduced.

Typically, the compositions comprise at least 0.01 wt % polymer, on product. Preferably the level of polymer is 0.05–5.0 wt % at which level the anti-resoiling benefits become particularly significant. More preferably 0.1–2.0 wt % of polymer is present. We have determined that higher levels of polymer do not give significant further advantage with common dilution factors, while increasing the cost of compositions. However, for very concentrated products which are diluted prior to use, the initial polymer level can be as high as 5% wt.

Compositions according to the invention can also contain, in addition to the ingredients already mentioned, various other optional ingredients such as, solvents, colourants, optical brighteners, soil suspending agents, detersive enzymes, compatible bleaching agents, gel-control agents, freeze-thaw stabilisers, further bactericides, perfumes and opacifiers.

The most preferred formulations according to the present invention, excluding minors, comprise.

For general use products:

a) 3–10% wt of an ethoxylated alcohol nonionic surfactant having a C8–C14 alkyl radical and an ethoxylation value of 5–10, b) 1–4% wt of an ortho-hydroxy benzoic acid wherein each further substituent in the ring is selected from the group comprising H— and HO—, c) 1–5% wt of an aliphatic polycarboxylic acid, and, d) 0–5% wt of an alkali metal sulphonate hydrotrope;

For concentrated products: a) 10–20% wt of an ethoxylated alcohol nonionic surfactant having a C8–C14 alkyl radical and an ethoxylation value of 5–10, b) 2–8% wt of an ortho-hydroxy benzoic acid wherein each further substituent in the ring is selected from the group comprising H— and HO—, c) 5–10% wt of an aliphatic polycarboxylic acid, and, d) 0–5% wt of an alkali metal sulphonate hydrotrope;

For sprayable products:

a) 1–5% wt of an ethoxylated alcohol nonionic surfactant having a C8–C14 alkyl radical and an ethoxylation value of 5–10, b) 0.05–1% wt of an ortho-hydroxy benzoic acid wherein each further substituent in the ring is selected from the group comprising H— and HO—, and, c) 0.1–1% wt of an aliphatic polycarboxylic acid, and;

d) 0–2% of an alkali metal sulphonate hydrotrope;

The present invention will be further described by way of example and with reference to the accomanying figures wherein:

FIG. 1: Shows the selective synergy between surfactant types and salicylic acid at pH 4.0 against *P. aeruginosa.*

Figure 2:
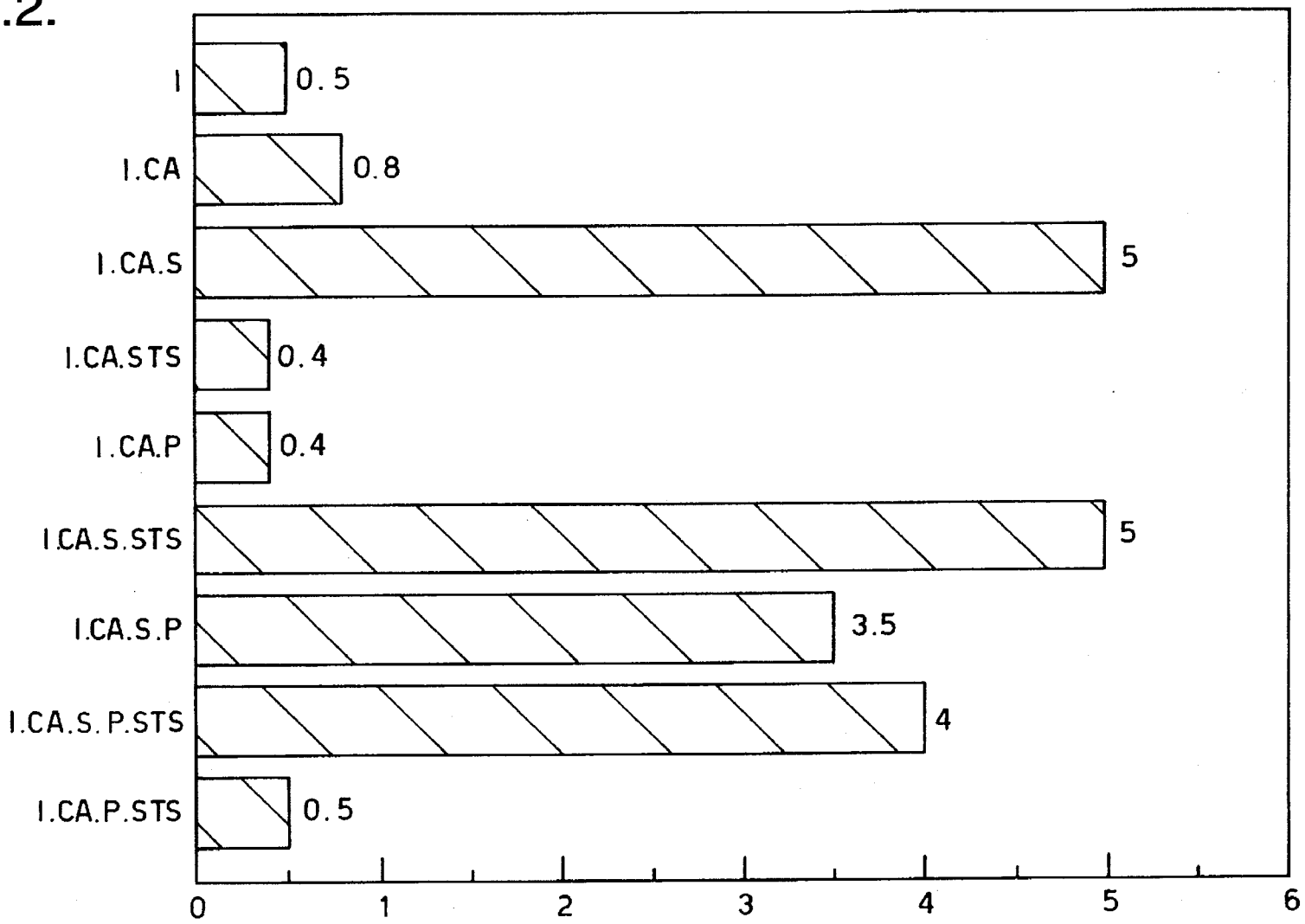

FIG. 2: Shows the selective synergy between nonionic surfactant and salicylic acid at pH 4.0 against *S. aureus.*

Figure 3:
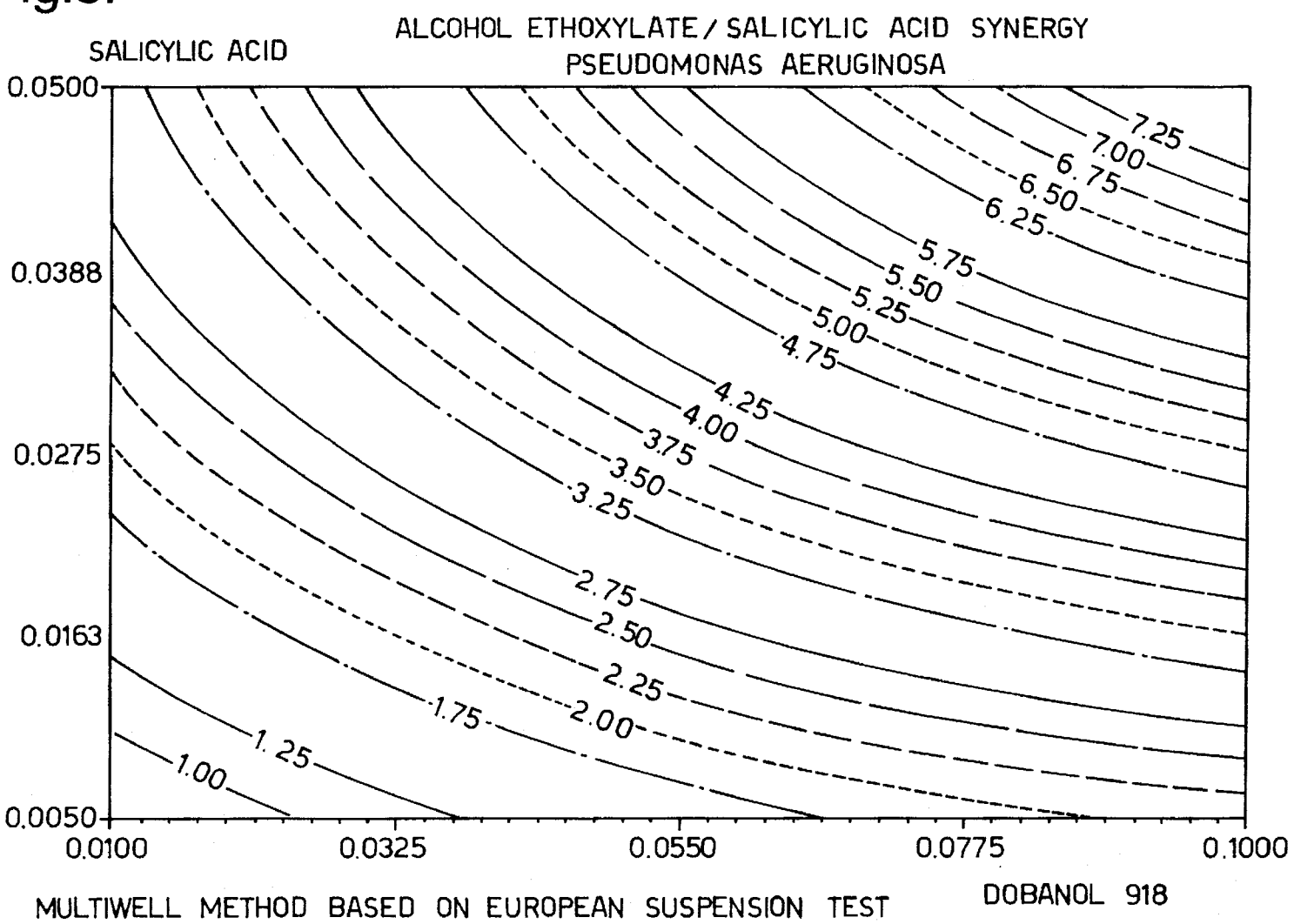

FIG. 3: Shows the selective synergy between ethoxylated alcohol nonionic surfactant and salicylic acid at pH 3.5 against *P. aeruginosa.*

EXAMPLES

The following bacterial strains were used in the suspension tests of examples 1 and 2:

*Pseudomonas aeruginosa*: ATCC 15442

*Staphylococcus aureus*: NCTC 6538

Microorganisms were taken from slopes and cultured at 37° C. (bacteria) or 28° C. (yeast) with constant agitation for 24 hours in nutrient broth (bacteria) or Sabouraud-dextrose liquid (yeast). Cells were recovered by centrifugation (10 min, 4100 rpm) and resuspended in ¼ strength Ringer's buffer to give a suspension of $10^9$–$10^{10}$ cfus/ml.

Test solutions were freshly prepared in sterile distilled water and the pH adjusted accordingly. Sufficient bacterial suspension was added to each test solution to give a final concentration of $10^8$ bacteria/ml. After a 5 min contact time, 1 ml of the test solution was added aseptically to 9 ml of inactivation liquid (3% (w/v) Tween 80 (TM), 0.3% (w/v) Lecithin, 0.1% (w/v) Bacteriological Peptone made up in pH 7.2 phosphate buffer) and then serially diluted into ¼ strength Ringer's buffer. Viable organisms were determined by culturing on Nutrient or Tryptone-soya peptone agar (bacteria) and Malt Extract agar (yeast) for 48 hours at 37° C. (bacteria) or 28° C. (yeast).

EXAMPLE 1

FIG. 1 shows the selective synergy between surfactant types and salicylic acid at pH 4.0 against *Ps. aeruginosa,* give a five minute contact time. All experiments were performed at a 30-fold dilution of a base comprising 1% surfactant and 0.8% citric acid. The surfactants listed in Table 1.1 were used:

TABLE 1.1

| Trade name | Type | Chain length | Maker |
|---|---|---|---|
| Empigen BB | Alkylbetaine | $C_{12}/C_{14}$ | Albright & Wilson |
| Amonyl 380 BA | Amidobetaine | Coco (topped) | Sèppic |
| Empigen OB | Amine Oxide | $C_{12}/C_{14}$ | Albright & Wilson |
| Rewoteric AM V | Glycinate | Coco | Rewo Chemicals |
| Amphionic SFB* | Biocidal ampholyte | $C_{10}$–$C_{16}$ | Rhone-Poulenc |
| Rewoteric AM-VSF | Propionate | Coco | Rewo Chemicals |
| Rewoteric AM CAS | Sulphobetaine | Coco | Rewo Chemicals |
| Rewoteric QAM* | Cationic amphoteric | Coco | Rewo Chemicals |

TABLE 1.1-continued

| Trade name | Type | Chain length | Maker |
|---|---|---|---|
| Imbentin 91/35/OFA | Alcohol ethoxylate | $C_{10}$ 5EO | Kolbe |

*Marketed as hygiene agents

All the trade names given in table 1.1 are believed to be trade-marks. Examples 1A differed from Example 1B in that salicylic acid was present in the formulations of examples 1B at a level of 1% wt. Results are presented in table 1.2 below, as log kill values.

TABLE 1.2

| Surfactant | Example 1A | Example 1B (+ salicylic) |
|---|---|---|
| Empigen BB | 1 | 5 |
| Amonyl 380 BA | 0.1 | 2 |
| Empigen OB | 5 | 8 |
| Rewoteric AM V | 1 | 2 |
| Amphionic SFB | 2 | 7 |
| Rewoteric AM-VSF | 0.5 | 1 |
| Rewoteric AM CAS | 1 | 1 |
| Rewoteric QAM | 3 | 5 |
| Imbentin 91/35/OFA | 0.1 | 2.5 |

From FIG. 1 and table 1.2 it can be seen that the Imbentin OFA gave marked synergy under the conditions of the experiment, improving from insignificant log kill in the absence of salicylate to a significant log kill in the presence of salicylate.

EXAMPLE 2

FIG. 2 shows the selective synergy between nonionic surfactant and salicylic acid at pH 4.0 against *S. aureus*. In the figure the components are identified as in Table 2.1 below. Versicol E11 is a polyacrylic acid polymer at the pH of the product.

TABLE 2.1

| Code | Component | Level when present |
|---|---|---|
| I | Imbentin 91/35/OFA | 7% |
| CA | Citric acid | 1% |
| S | Salicylate | 2% |
| STS | Sodium Toluene Sulphonate | 2.56% |
| P | Versicol E11 (RTM) | 0.5% |

Experiments were performed with one or more of the components listed in table 2.1 present. Results are presented in table 2.2 below. The compositions were not significantly thickened due to the presence of the polymer.

TABLE 2.2

| Present | Log Kill |
|---|---|
| I. | 0.5 |
| I.CA | 0.8 |
| I.CA.S | 5 |
| I.CA.STS | 0.4 |
| I.CA.P | 0.4 |
| I.CA.S.STS | 5 |
| I.CA.S.P | 3.5 |
| I.CA.S.P.STS | 4 |
| I.CA.P.STS | 0.5 |

From FIG. 2 and table 2.2 it can be seen that the synergistic hygiene effect in the composition is due to the presence of both nonionic surfactant and the aromatic organic acid. It can also be seen that the presence of hydrotrope sodium toluene sulphonate and the polymer do not have a significantly detrimental effect on the hygiene performance of the composition.

EXAMPLE 3

Table 3.1 below gives additional disinfectant formulations and lists the Log Kill achieved against *Ps. aeruginosa*. *Ps. aeruginosa* is a gram-negative organism and is considered to be more difficult to kill than many other species of bacteria.

In example 3, 8 formulations were tested at a time in a 96 well (8×12) microtitre plate, using a test related to the 'European Suspension Test'.

1 ml of formulation was diluted into 14 ml of water of standard hardness (17 degrees German). 5 ml of the diluted solution was added to 4 ml of distilled water and 270 μl of the product dosed into one well of the microtitre plate. This was repeated for the remaining 7 formulations being tested on this plate. 8 wells were simultaneously inoculated with 30 μl bacterial suspension using a multipipette and agitated. After a 5 mins (+/−5 secs) contact time 30 μl samples were transferred into 270 μl inactivation liquid (as used in examples 1 and 2) using a multipipette and mixed. After 5 mins (+/−1 min) 30μ samples were serially diluted into 270 μl Ringers solution using a mutipipette and mixed. TVC was determined by a spread plate method: plating out 10 μl (in triplicate) onto TSA and incubating for 24 hours at 30° C.

Results are given in table 3.1 below for formulations comprising: Dobanol 91-8 (as surfactant), sodium toluene sulphonate (as hydrotrope: to a cloud point of 50 degrees), salicylic acid, polymer, citric acid (to pH 3.5), blue dye and one of two commercially available perfumes.

TABLE 3.1

| Example | Nonionic (Dobanol 91-8 [RTM]) | Hydrotrope STS | Polymer (Versico 1 E11 [RTM]) | Salicylic acid | Perf A. | Perf B. | Blue Dye | Log Kill |
|---|---|---|---|---|---|---|---|---|
| 3a | 0 | 0 | 0 | 0 | 0 | 0 | 0 | 0.2 |
| 3b | 5.25 | 6.2 | 0.25 | 2 | 0.3 | 0 | tr. | 6.3 |
| 3c | 8.75 | 3 | 0.25 | 2 | 0.3 | 0 | tr. | 6.1 |
| 3d | 5.25 | 6.8 | 0.25 | 2 | 0 | 0.2 | 0 | 6.9 |

TABLE 3.1-continued

| Example | Nonionic (Dobanol 91-8 [RTM]) | Hydrotrope STS | Polymer (Versico 1 E11 [RTM]) | Salicylic acid | Perf A. | Perf B. | Blue Dye | Log Kill |
|---|---|---|---|---|---|---|---|---|
| 3f | 8.75 | 4 | 0.25 | 2 | 0 | 0.2 | 0 | 6.3 |
| 3g | 5.25 | 5.1 | 0.25 | 2 | 0 | 0 | tr. | 6.0 |
| 3h | 8.75 | 3.8 | 0.25 | 2 | 0 | 0 | tr. | 5.8 |

From table 3.1 it can be seen that the presence of hydrotrope, polymers, perfume and dye has no significant detrimental effect on the log kill of the formulations, which achieved better than log 5 kill.

EXAMPLE 4

Example 3 was repeated to cover a range of concentrations of nonionic and salicylic acid under typical in-use conditions, i.e. concentrations of 0.01–0.1% wt of Dobanol 91-8 (TM) nonionic surfactant and 0,005–0.5% wt salicylic acid.

Nine compositions were prepared which comprised 0.5, 2.0 or 3.5% wt Dobanol 91-8 and 0.5, 1.0 or 1.5% wt salicylic acid. These compositions contained 3.5% wt citric acid and the cloud point was adjusted to 50 Celcius with sodium toluene sulphonate. The polymer used in example 3 was omitted.

Results are shown in FIG. 3, which portrays the best fit of a response surface relating log-kill to in-use concentration for a plurality of experiments conducted using the above mentioned compositions at dilutions of 1:30, 1:45 and 1:90, i.e. twenty seven separate experiments were performed, each being performed four times and the log-kills averaged.

The equation of the surface in FIG. 3 is that the square-root of the log kill is equal to 0.574, plus 11.98 times the concentration of nonionic, plus 31.21 times the concentration of salicylic acid, minus 55.24 times the square of the concentration of nonionic, minus 217.3 times the square of the concentration of salicylic acid, plus 111.1 times the product of the concentrations of nonionic and salicylic acid: all concentrations being the in-use concentrations. From the existence of the cross term, which was found to be significant at the 97.8% confidence level it can be seen that there is a synergistic effect due to the interaction of the alcohol ethoxylate surfactant and the salicylate.

EXAMPLE 5

Tables 5.1 and 5.2 show the results of a further series of formulations according to the present invention. The nonionic surfactant was IMBENTIN 91-35 OFA (TM, ex. Kolb AG). The amphoteric surfactant was EMPIGEN BB (TM, ex Albright and Wilson). The polyacrylate was VERSICOL E11 (TM). Example A is a product suitable for general use, Example B is a concentrate and Example C a sprayable product.

TABLE 5.1

| Components | Example | | |
|---|---|---|---|
| (parts wt) | 5A | 5B | 5C |
| Nonionic | 7.0 | 14.0 | 2.0 |
| Polyacrylate | 0.5 | 1.0 | 0.14 |

TABLE 5.1-continued

| Components | Example | | |
|---|---|---|---|
| (parts wt) | 5A | 5B | 5C |
| Salicylate | 2.0 | 4.0 | 0.1 |
| Amphoteric | 3.0 | 4.0 | 0.1 |
| Citric Acid | 3.5 | 7.0 | 0.3 |
| STS | 2.6 | 2.6 | 0.0 |
| pH | 3.5 | 3.5 | 3.7 |

Caustic soda was added to the indicated pH. Products were made up to 100 wt % with water. The performance of products was evaluated using the method of the European Suspension Test, as described above. Results for a range of microbes are shown for formulations 5A, 5B and 5C in table 5.2 below.

TABLE 5.2

| Microbe | Log Kills | | |
|---|---|---|---|
| | 5A | 5B | 5C |
| *P. mirablis** | 5.7 | 5.0 | — |
| *P. mirablis#* | 4.0 | 5.8 | — |
| *P. mirablis* | — | — | 9.8 |
| *E. faecium** | 6.0 | 6.0 | — |
| *E. faecium#* | 6.0 | 5.0 | — |
| *E. faecium* | — | — | 9.0 |
| *P. aeriginosa** | 4.5 | 4.0 | — |
| *P. aeriginosa#* | 4.5 | 4.5 | — |
| *P. aeriginosa* | — | — | 6.0 |
| *S. cerevisiae** | 1.0 | 1.0 | — |
| *S. cerevisiae#* | 7.0 | 6.0 | — |
| *S. cerevisiae* | — | — | 8.0 |
| *S. aureus** | 3.5 | 4.0 | — |
| *S. aureus#* | 5.8 | 7.8 | — |
| *S. aureus* | — | — | 6.0 |

*indicates high soil conditions
#indicates hard water was used

From the above results it can be seen that the compositions of the invention are effective against a range of microbes under a range of conditions.

EXAMKPLE 6

Table 6.1 shows the relative effectiveness of a series of formulations comprising a variety or organic acids and surfactant.

The alcohol ethoxylate nonionic surfactant used was IMBENTIN 91-35 OFA (TM, ex. Kolb AG) used at 0.05 wt %.

Results were obtained by preparing samples of around $10^8$ cells/ml of *S. aureus* and $10^7$ cells/ml of *S. cerevisiae,* in diluted formulation at pH 4, comprising both the acids and surfactant as given in Table 6.1.

Antimicrobial activity was determined by incubating the samples for five minutes and thereafter determining total viable count/ml by plating-out samples in serial dilution onto nutrient agar (ex OXOID) and SABS agar for the bacteria and the yeast respectively, and counting colonies formed after incubation of the plates. From these colony counts the 'log kill' could be obtained. The results given are expressed in terms of log kill for compositions comprising the acid alone (results are given in the table headed 'acid'), the nonionic alone (results are given in the table headed 'nonionic') and the combination of the acid and the nonionic (results being given in the table headed 'acid+nonionic'. Comparative examples were performed with the corresponding hydroxy-substituted acids.

TABLE 6.1

| Salicyclic acid | LOG KILLS (*S. AUREUS*) | | |
|---|---|---|---|
| derivative | Acid | Nonionic | Acid & Nonionic |
| 3-methyl | 0 | 0.5 | 7.0 |
| 3-hydroxy | 0 | 0.5 | 4.0 |
| 4-methyl | 0 | 0.5 | 7.0 |
| 4-hydroxy | 0 | 0.5 | 3.5 |
| 5-methyl | 0 | 0 | 7.0 |
| 5-hydroxy | 0 | 0 | 2.0 |

TABLE 6.2

| | LOG KILLS (*S. cerevisiae*) | | |
|---|---|---|---|
| Acid | Acid | Nonionic | Acid & Nonionic |
| 5-methyl | 0 | 0 | 5.0 |
| 5-hydroxy | 0 | 0 | 0 |

From the table it can be seen that the acids alone have no significant antimicrobial effect at this concentration. The nonionic surfactant alone shows a slight antimicrobial effect at this concentration.

In combination with the nonionic surfactant, it can be seen that the 3, 4 and 5 alkyl substituted acids are all effective against the bacteria, and that the antimycotic activity is also indicated. It can also be seen that the hydroxy-substituted acids were less effective than the corresponding alkyl substituted acids.

EXAMPLE 7

Table 7.1 shows the relation between the cloud point of the compositions and the level and type of hydrotrope present. The compositions comprised 7% Dobanol 91-5 (TM), 2% Empigen BB (TM), 0.5% Versicol (TM) E11 polymer, 2% salicylate, 3.5% citric acid and were perfume free.

TABLE 7.1

| | Cloud Point (Celcius) | | |
|---|---|---|---|
| STS Level | 0% sal | 1% n sal | 2% sal |
| 0 | 40 | — | 7 |
| 2.5 | 64 | 51 | 25 |
| 5 | >100 | >100 | 95 |

From these results it can be seen that the presence of the benzoic acid derivative progressively lowers the cloud point to the point where a cloudy product is obtained at room temperature. However, this defect can be cured by the addition of the hydrotrope.

We claim:

1. An antimicrobial hard surface cleaning composition comprising:

a) 0.01 to 8 wt. % of an ortho-hydroxy benzoic acid derivative selected from the group consisting of:
2-hydroxy benzoic acid,
2-hydroxy benzoic acid substituted with a $C_1$–$C_{12}$ alkyl group at the 3, 4 or 5 positions,
2-hydroxy benzoic acid substituted with a hydroxyl group at the 3, 4 or 5 positions,
and mixtures thereof; and b) 0.01 to 8 wt. % of an amphoteric surfactant selected from the group consisting of: betaines, amine oxides, alkyl-amino glycinates; and c) 0.1 to 30 wt. % of a $C_8$–$C_{22}$ ethoxylated alcohol nonionic surfactant with 4 to 10 ethoxy groups per molecule, said composition having a pH of 3.2–4.0.

2. Composition according to claim 1 wherein the ethoxylated alcohol is an ethoxylated alcohol having a chain length of $C_8$–$C_{14}$ and 4–10 ethoxy groups per molecule.

3. Composition according to claim 1 wherein the weight ratio of the nonionic surfactant to the ortho-hydroxy benzoic acid derivative is in the range 50:1 to >1:1.

4. Composition according to claim 1 further comprising:

c) 0.5–5% wt of citric acid and its salt, and, d) 0–5% wt of an alkali metal sulphonate hydrotrope.

5. Composition according to claim 1 further comprising:

c) 5–10% wt of citric acid and its salt, and, d) 0–5% wt of an alkali metal sulphonate hydrotrope.

6. Composition according to claim 1 further comprising c) 0.1–1% wt of citric acid and its salt, and;

d) 0–2% wt of an alkali metal sulphonate hydrotrope.

* * * * *